US005403686A

United States Patent [19]

Bugner et al.

[11] Patent Number: 5,403,686

[45] Date of Patent: Apr. 4, 1995

[54] ELECTROPHOTOGRAPHIC ELEMENT AND IMAGING METHOD EXHIBITING REDUCED INCIDENCE OF LASER INTERFERENCE PATTERNS

[75] Inventors: Douglas E. Bugner, Rochester; Hsin C. Kan, Pittsford, both of N.Y.; Neil F. Haley, Wellington, Colo.; Michael R. Detty, Rochester; Rodney R. Bucks, Webster, both of N.Y.

[73] Assignee: Eastman Kodak Company, Rochester, N.Y.

[21] Appl. No.: 127,226

[22] Filed: Sep. 27, 1993

[51] Int. Cl.[6] ..... G03G 5/09

[52] U.S. Cl. ..... 430/58; 430/78; 430/83

[58] Field of Search ..... 430/58, 59, 69, 78, 430/83, 95

[56] References Cited

U.S. PATENT DOCUMENTS

| | | | |
|---|---|---|---|
| 4,496,730 | 1/1985 | Chen et al. | 430/23 |
| 4,552,825 | 11/1985 | Chen et al. | 430/83 |
| 4,603,098 | 7/1986 | Franke et al. | 430/83 |
| 4,632,895 | 12/1986 | Patel et al. | 430/210 |
| 4,634,553 | 1/1987 | Detty et al. | 540/1 |
| 4,681,827 | 7/1987 | Franke et al. | 430/83 |
| 4,701,396 | 10/1987 | Hung et al. | 430/78 |
| 4,711,838 | 12/1987 | Greskowiak et al. | 430/568 |
| 4,756,993 | 7/1988 | Kitatani et al. | 430/69 |
| 4,788,128 | 11/1988 | Barlow | 430/200 |
| 4,882,254 | 11/1989 | Loutfy et al. | 430/59 |
| 4,882,265 | 11/1989 | Laganis et al. | 430/522 |
| 4,913,996 | 4/1990 | Kung et al. | 430/59 |
| 4,921,773 | 5/1990 | Melnyk et al. | 430/132 |
| 4,933,269 | 6/1990 | Parton et al. | 430/522 |
| 4,975,362 | 12/1990 | Parton et al. | 430/584 |
| 4,983,483 | 1/1991 | Tsai | 430/59 |
| 5,028,506 | 7/1991 | Yamazaki et al. | 430/58 |
| 5,051,328 | 9/1991 | Andrews et al. | 430/56 |
| 5,061,618 | 10/1991 | Parton et al. | 430/584 |
| 5,066,557 | 11/1991 | Robinette et al. | 430/58 |
| 5,102,758 | 4/1992 | Kazmaier | 430/58 |

*Primary Examiner*—John Goodrow
*Attorney, Agent, or Firm*—Willard G. Montgomery

[57] ABSTRACT

Electrophotographic elements including near-infrared radiation absorbing sensitizers and selected near-infrared radiation absorbing additives exhibit a reduced tendency toward the formation of laser interference patterns. These elements can be utilized in electrophotographic imaging processes including the steps of electrostatically charging the element, imagewise exposing the charged element to near-infrared radiation to form an electrostatic latent image, developing the electrostatic latent image by applying charged toner particles to the element to produce a toned image, and transferring the toned image to a suitable receiver.

20 Claims, No Drawings

ELECTROPHOTOGRAPHIC ELEMENT AND IMAGING METHOD EXHIBITING REDUCED INCIDENCE OF LASER INTERFERENCE PATTERNS

FIELD OF INVENTION

This invention relates to electrophotographic elements and a method of exposing such elements with near-infrared radiation.

BACKGROUND OF THE INVENTION

Photoconductive elements for use in electrophotographic imaging are well known. Photoconductive elements are used for conventional optical exposures such as those commonly utilized in photocopiers and photoduplicators. Photoconductive elements are also known which can be imaged either by an array of light emitting diodes (LEDs) or by scanning laser exposure. With either LED or laser exposure, the image to be reproduced has been converted by a variety of means into a stream of digital information. Machines which employ digitally imaged photoconductive elements are generally referred to as printers, sometimes laser printers.

The lasers or LEDs which are used to carry out digital imaging generally emit light in the near-infrared (near-IR) region of the spectrum, defined for the purposes of this invention as light having a wavelength in the range of about 650 to 900 nm. Accordingly, the photoconductive elements must be capable of absorbing light in this wavelength range. Many near-IR sensitive photoconductive elements exhibit problems affecting their performance. For example, when such elements are imaged with relatively high power near-IR lasers, the near-IR absorbing dye or pigment present in the photoconductive element may fail to absorb all of the incident light emitted by the laser. As a result, the excess, unabsorbed light generates an image artifact generally known as a laser interference pattern (also known as "plywood" or "wood grain" effect).

Other solutions to this problem have included use of a conductive support having a roughened surface as disclosed in Japanese Patent Application Serial Nos. 162975/83, 17 1057/83, 112049/85. Another potential solution is the use of a support having a light scattering layer, on the side opposite the photosensitive layer, which prevents laser radiation from being reflected back to the photosensitive layer thereby causing the laser interference pattern as disclosed in U.S. Pat. Nos. 4,756,993 to Kitatani et al. and 5,051328 to Andrews et al. However, these solutions for the problem of laser interference patterns are not without disadvantages. They introduce further complexity into the formation of the element, lessen the versatility of the element, and decrease the performance of the electrophotographic element. Accordingly, it is an object of the present invention to produce easily manufactured photoconductive elements which largely eliminate laser interference patterns while still maintaining good performance characteristics.

SUMMARY OF THE INVENTION

The present invention relates to an electrophotographic element for electrostatic imaging comprising a conductive substrate and a photoconductive layer including a near-infrared radiation absorbing sensitizer and a near-infrared radiation absorbing additive.

In an alternative embodiment of the present invention, a multiactive electrophotographic element includes a conductive substrate, a charge generation layer including a near-infrared radiation absorbing sensitizer, a charge-transport layer, and a near-infrared absorbing additive present in the charge-transport layer.

The present invention also provides an electrophotographic imaging method which utilizes the above-described element. The method comprises the steps of first electrostatically charging an element comprising a conductive substrate, a charge generation layer including a near-infrared radiation absorbing sensitizer, a charge transport layer, and a near-infrared radiation absorbing additive present in said electrophotographic element between said conductive substrate and said charge generation layer. The charged element is then exposed imagewise to near-infrared radiation to form an electrostatic latent image which is developed by applying charged toner particles to the element to produce a toned image. The toned image is then transferred to a suitable receiver.

In an alternative embodiment of the present invention, an electrophotographic imaging method is disclosed that includes the step of first electrostatically charging an element comprising a conductive substrate and a photoconductive layer including a near-infrared radiation absorbing sensitizer and a near-infrared radiation absorbing additive having a molar extinction coefficient greater than about $1\times10^5$ L-mol$^{-1}$-cm$^{-1}$. The electrostatically charged element is then exposed imagewise to near-infrared radiation to form an electrostatic latent image. The latent image is developed by applying charged toner particles to the element to produce a toned image which is then transferred to a suitable receiver.

The imaging method and elements of the present invention provided are near-infrared sensitive and exhibit a reduced tendency toward the formation of laser interference patterns without generating deleterious side effects such as lower photosensitivity, increased toe voltages, poor charge acceptance, higher dark conductivity and the like. Furthermore, the elements of the present invention unexpectedly exhibit improved performance in the form of lower dark conductivity.

DETAILED DESCRIPTION OF THE INVENTION

As noted above, the present invention relates to an electrophotographic element for electrostatic imaging. In one embodiment, the element of the present invention comprises a conductive substrate and a photoconductive layer including a near-infrared radiation absorbing sensitizer and a near-infrared radiation absorbing additive.

Useful conductive substrates include any of the electrically conductive layers and supports conventionally used in electrophotographic processes. These include, for example, paper (at a relative humidity of about 20%), aluminum paper laminates, metal foils (e.g., aluminum foil, zinc foil, etc.), metal plates (e.g., aluminum, copper, zinc, brass), and galvanized plates, regenerated cellulose and cellulose derivatives, and certain polyesters, especially polyesters having a thin electroconductive layer (e.g., cuprous iodide) coated thereon.

In a single layer element according to the present invention, the photoconductive layer contains a near-infrared radiation absorbing sensitizer and a near-infrared radiation absorbing additive. The near-infrared sensitizer used can generally include any dye or pigment sensitive to near-infrared radiation. Suitable dyes and pigments include those selected from the cyanine family, particularly those selected from the phthalocyanine family. Preferred sensitizers include pigments such as phthalocyanine, titanyl phthalocyanine, and, most preferably, titanyl tetrafluoro-phthalocyanine. Other examples of useful near-infrared absorbing sensitizers are contained in U.S. Pat. Nos. 4,756,993 to Kitatani et at. and 4,882,254 to Loutfy et at., the disclosures of which are hereby incorporated by reference.

The near-infrared sensitizer is present in the single layer element at a concentration of 0.1 to 10 weight percent, preferably 0.1 to 1.0 weight percent.

The concentration of near-infrared sensitizer is carefully chosen so as to balance a number of electrophotographic properties of the element (e.g., photosensitivity, dark conductivity, regenerational stability, and the like) as well as a number of important physical properties (e.g., adhesion to substrate, resistance to abrasion, cracking, and the like). Consequently, it is not possible to simply increase the concentration of the sensitizer to eliminate laser interference patterns without adversely effecting one or more of these properties.

Applicants have unexpectedly discovered, in accordance with the present invention, that the inclusion of a near-infrared radiation absorbing additive to the electrophotographic element (in addition to the near-infrared sensitizer) largely eliminates laser interference patterns and lowers the dark conductivity of the element. In the single layer element of the present invention, the near-infrared additive should have a molar extinction coefficient in solution of greater than about $1\times10^4$L-mol$^{-1}$-cm$^{-1}$ preferably $1\times10^5$L-mol$^{-1}$-cm$^{-1}$. Molar extinction coefficient is defined by the Beer-Lambert Law: A=(E)(b)(c) wherein A is observed absorbance of the solution, C is the concentration of the absorbing species in moles/liter and b is the path length of the solution in centimeters. E is a proportionality constant known as the molar extinction coefficient.

Examples of useful near-infrared additives include: compounds having the formula:

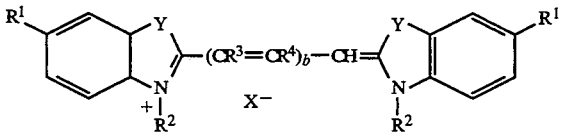

wherein:

$R^1$ is —H, —$NO_2$, alkyl, aryl, —$SO_2R^5$, halo, —$OR^5$,

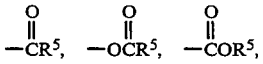

where $R^5$ is alkyl, aryl, or substituted alkyl or aryl;

$R^2$ is —H or an alkyl from 1–12 carbons;

$R^3$ and $R^4$ can be the same or different and are

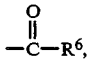

halo, alkyl, or aryl;

where $R^6$ is alkyl, aryl or substituted alkyl or aryl, or may be a link of 0–3 carbons to form a ring;

Y is —S—, —O—, or—$C(R^7)_2$— where $R^7$ is H or an alkyl group of 1–3 carbons;

—X is an anion; and b is an integer from 1–3; and compounds having the formula:

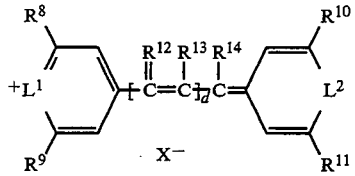

wherein $L^1$ and $L^2$ can be the same or different and are Te, Se, S, or O;

$R^8$, $R^9$, $R^{10}$, and $R^{11}$ can be the same or different and are —H or an alkyl group having from 1–5 carbons;

$R^{12}$, $R^{13}$, and $R^{14}$ can be the same or different and are —H or —$CH_3$;

—X is an anion; and d is 1 or 2.

Exemplary near-infrared additives include compounds having the formula:

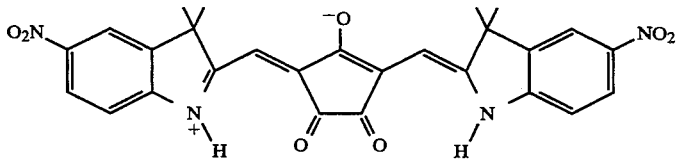

(1)

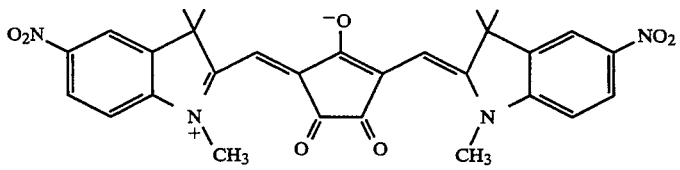

(2)

-continued
(3)
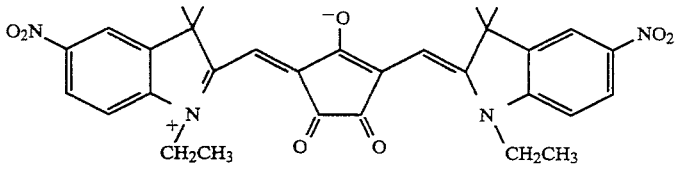
(4)
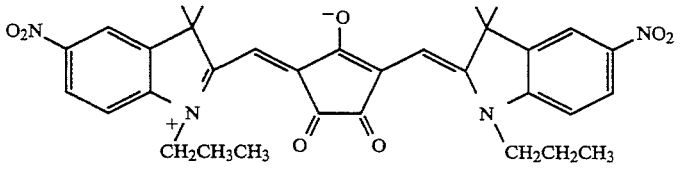
(5)
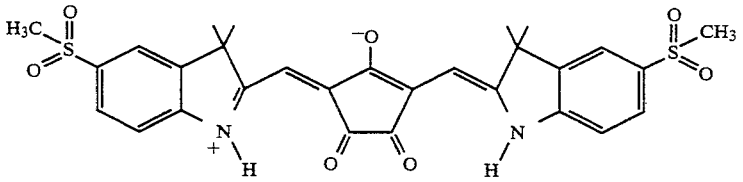
(6)
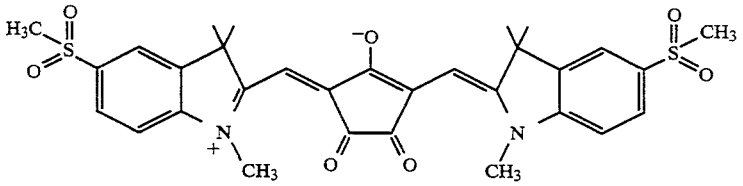
(7)
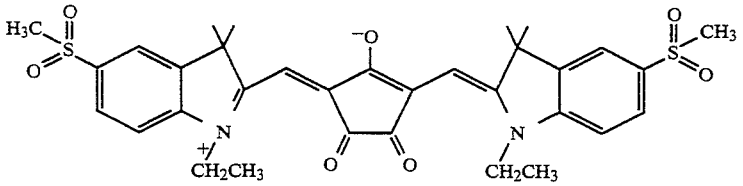
(8)
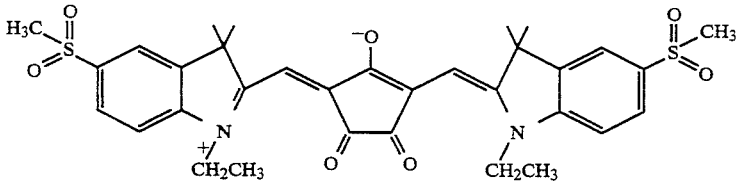
(9)
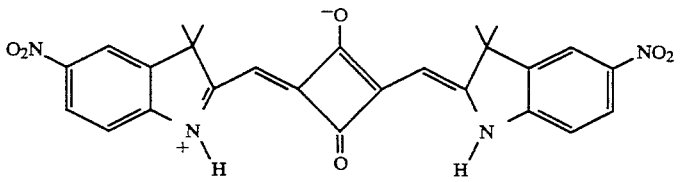
(10)
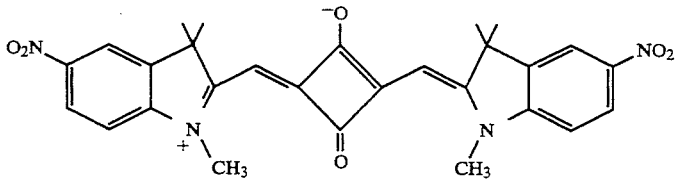

-continued
(11)
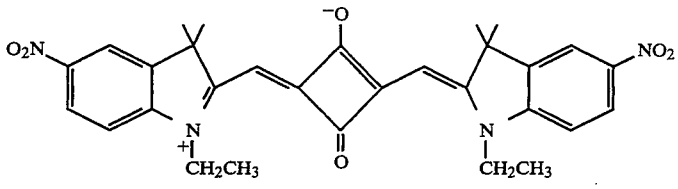
(12)
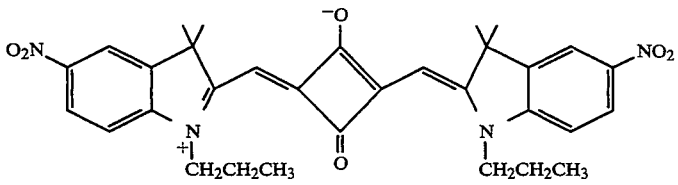
(13)
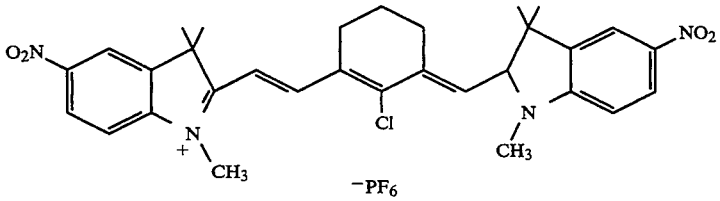
(14)
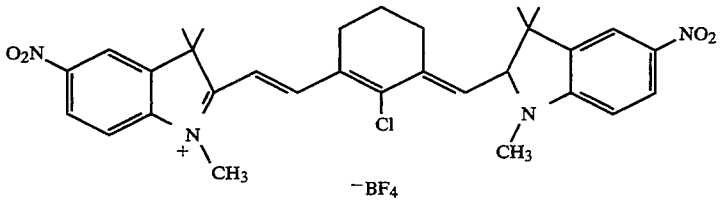
(15)
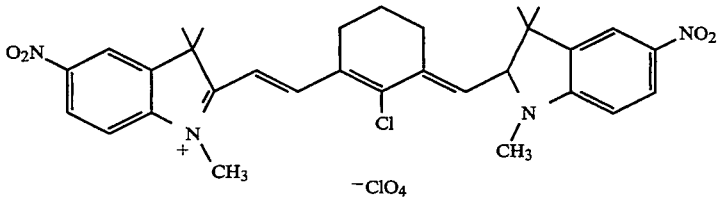
(16)
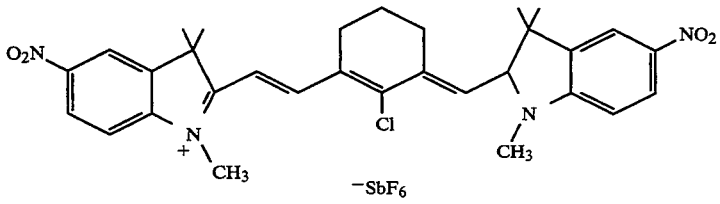
(17)
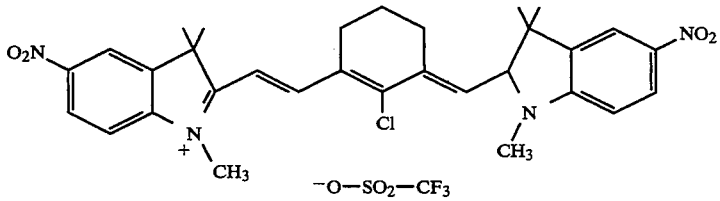

-continued
(18)
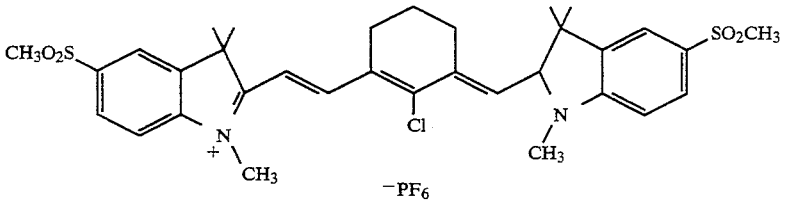
(19)
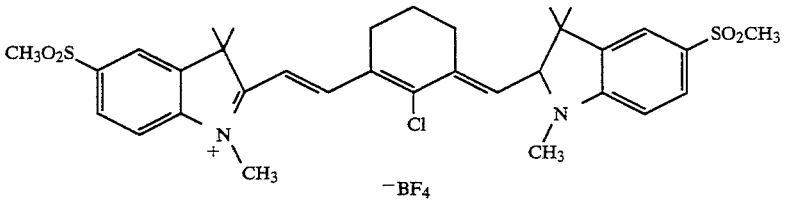
(20)
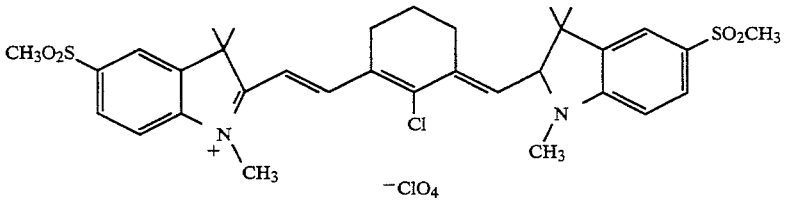
(21)
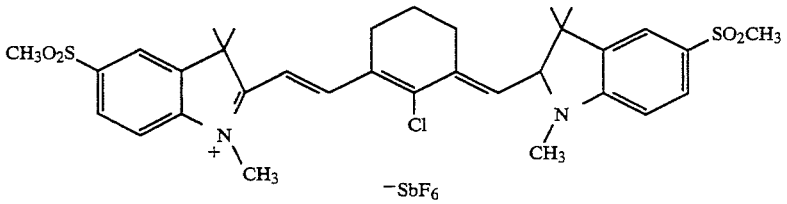
(22)
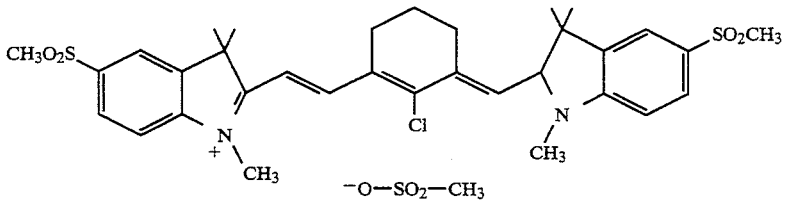
(23)
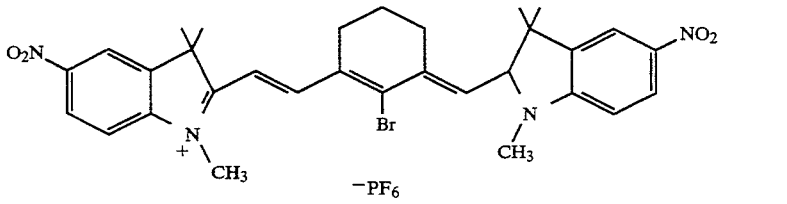
(24)
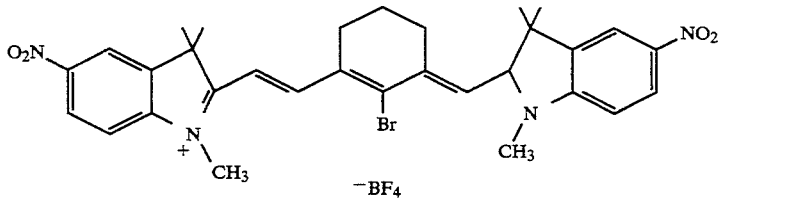

-continued
(25)
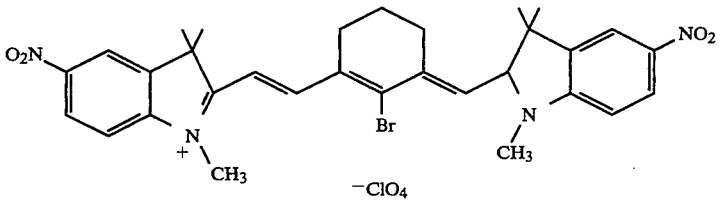
(26)
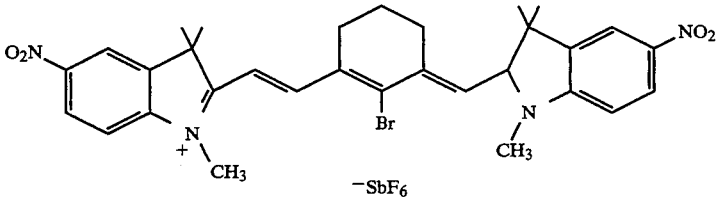
(27)
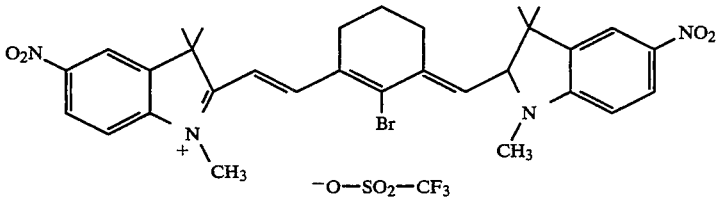
(28)
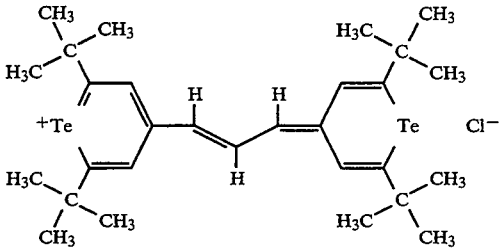
(29)
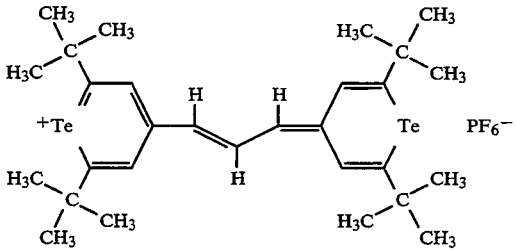
(30)
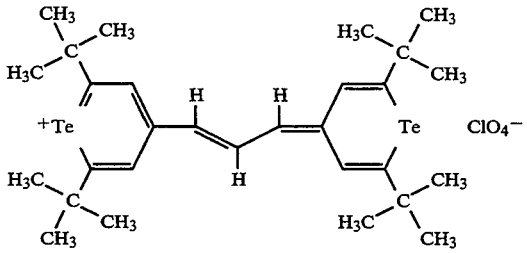
(31)
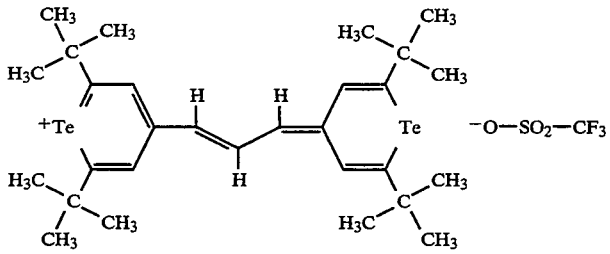

-continued
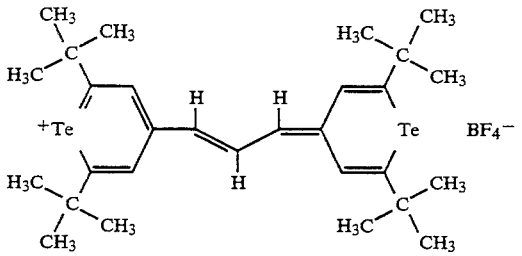
(32)
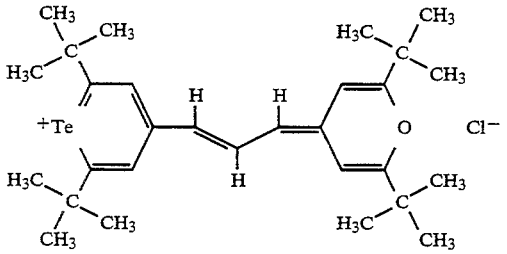
(33)
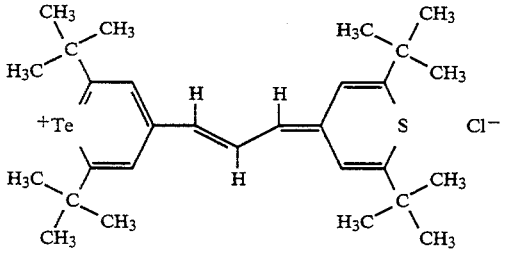
(34)
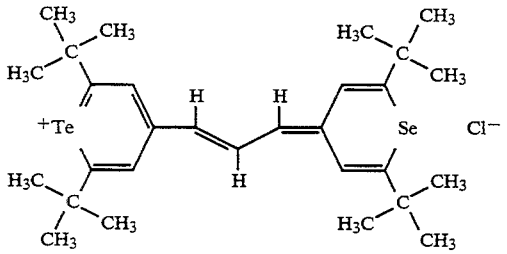
(35)
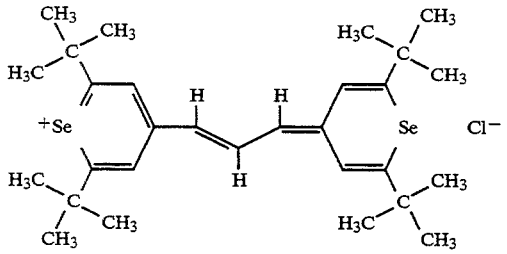
(36)
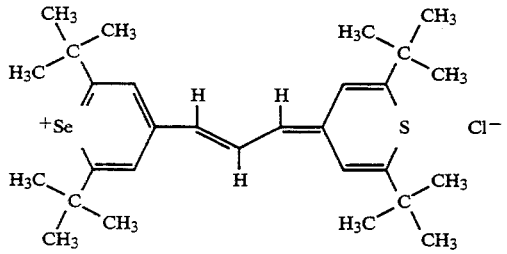
(37)

-continued
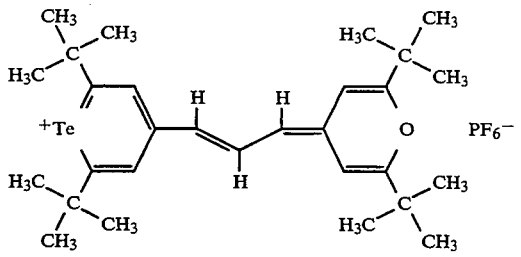
(38)
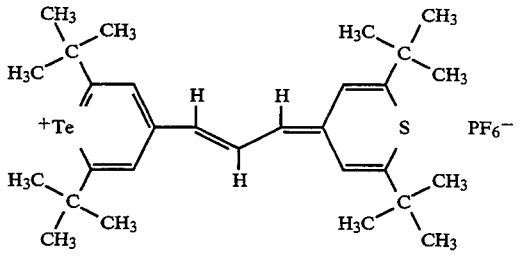
(39)
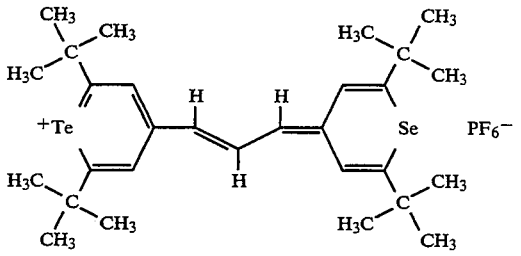
(40)
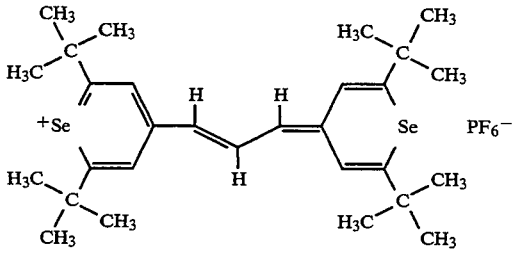
(41)
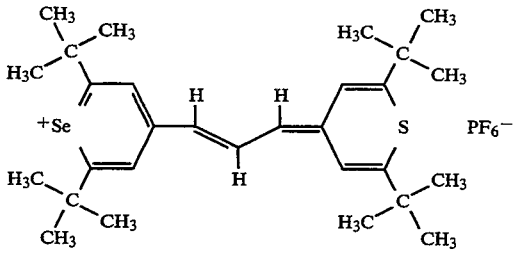
(42)
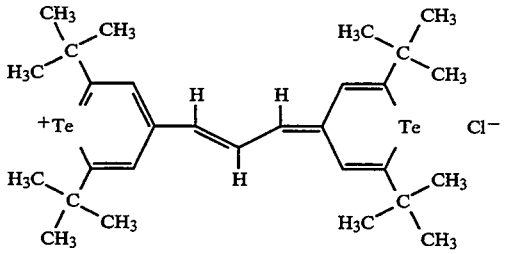
(43)

-continued

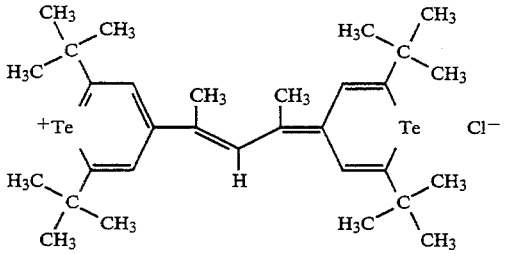

(44)

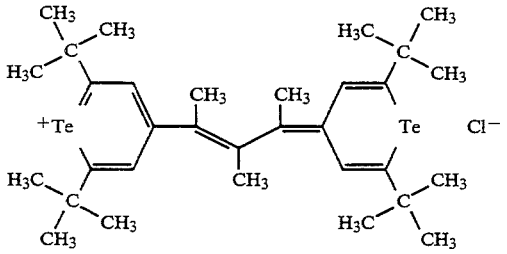

(45)

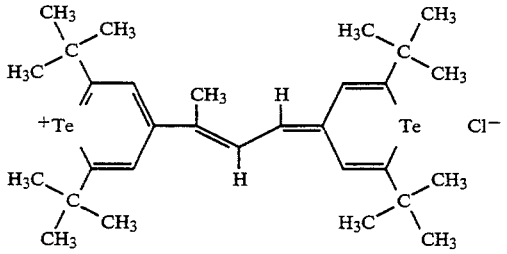

(46)

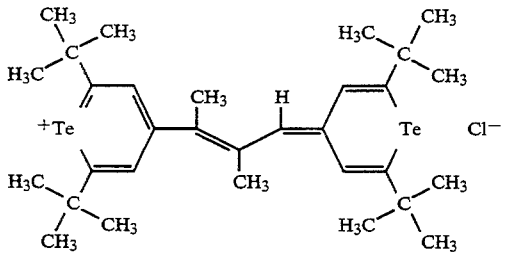

(47)

Especially preferred near-infrared additives are described by formulas (1), (2), (9), (10), (13), (28), and (29).

The near-infrared additive is present in the element at a concentration of 0.1 to 10 weight percent, preferably 0.1 to 1.0 weight percent. In practice, the level of a specific additive is adjusted by routine experimentation until the minimum amount necessary to eliminate laser interference patterns is found.

The photoconductive layer of the single layer element in the present element can optionally include a binder. Any of the binders conventionally used in electrophotographic elements can be utilized. Useful electrically insulating binders include polycarbonates, polyesters, polyolefins, phenolic resins, and the like. Such polymers should be capable of supporting an electric field in excess of $1\times10^5$V/cm (preferably, $1\times10^6$V/cm) and exhibit a low dark decay of electrical charge.

Preferred binders are styrene-butadiene copolymers, silicone resins, styrene-alkyd resins, soya-alkyd resins, poly(vinyl chloride), poly(vinylidene chloride), vinylidene chloride, acrylonitrile copolymers, poly(vinyl acetate), vinyl chloride copolymers, poly(vinyl acetals) (e.g., poly(vinyl butyral)), polyacrylic and methacrylic esters (e.g., poly(methyl methacrylate), poly(n-butyl methacrylate), poly(isobutyl methacrylate), etc.), polystyrene, nitrated polystyrene, poly(vinylphenol), polymethylstyrene, isobutylene polymers, polyesters, ketone resins, polyamides, polycarbonates, and the like. Methods of making resins of this type have been extensively described in the prior art. For example, styrene alkyd resins can be prepared according to the method described in U.S. Pat. Nos. 2,361,019 and 2,258,423. Suitable resins of the type contemplated for use in the elements of the present invention are sold under such tradenames as Vitel PE 101-X TM, Cymac TM, Piccapole 100 TM, Saran F-220 TM.

The binder, when used, is present in the single layer element in a concentration of 10 to 90 weight percent, preferably 40–60 weight percent. While the photoconductive layer of the present element can be affixed, if desired, directly to a conducting substrate or support, it may be desirable to use one or more intermediate subbing layers between the conducting layer or substrate and the photoconductive layer to improve adhesion to the conducting substrate and/or to act as an electrical and/or chemical barrier between the photoconductive layer and substrate.

Such subbing layers, if used, typically have a dry thickness in the range of about 0.1 to about 5 microns. Useful subbing layer materials include film-forming polymers such as cellulose nitrate, polyesters, copolymers or poly (vinyl pyrrolidone) and vinylacetate, and various vinylidene chloride-containing polymers including two, three and four component polymers prepared from a polymerizable blend of monomers or prepolymers containing at least 60 percent by weight of vinylidene chloride. Other useful subbing materials include the so-called tergels which are described in Nadeau et al, U.S. Pat. No. 3,501,301.

Optional overcoat layers are useful with the present invention, if desired. For example, to improve surface hardness and resistance to abrasion, the surface layer of the photoelectrographic element of the invention may be coated with one or more organic polymer coatings or inorganic coatings. A number of such coatings are well known in the art and accordingly an extended discussion thereof is unnecessary. Several such overcoats are described, for example, in *Research Disclosure*, "Electrophotographic Elements, Materials, and Processes", Vol. 109, page 63, Paragraph V, May, 1973, which is incorporated herein by reference.

In an alternate embodiment, the element of the present invention is a multiactive electrophotographic element including a conductive substrate (as described above), a charge generation layer (CGL), and a charge transport layer (CTL). A multiactive element according to the present invention is preferably an inverse composite structure; that is, a conductive support, a charge generation layer, and a charge transport layer separating the charge generation layer and the conductive support.

The CTL can include a wide range of charge transport materials, including monomeric, polymeric or inorganic materials. They can be used alone or in combination and can be n-type (electron transporters), p-type (hole transporters), or bimodal materials. Examples of the wide range of useful transport materials are disclosed in U.S. Pat. No. 4,701,396, which is incorporated herein by reference.

Preferably, the charge transport materials are incorporated in the charge transport layer as a solid solution in a polymeric binder. An especially preferred charge transport material is a mixture of tri-4-tolylamine, 1,1-bis-[4-(di-4-tolyamino)phenyl]cyclohexane, and diphenylbis-(4-diethylaminophenyl)methane, in a ratio of 19/19/2 by weight. Another preferred hole-transport material is 3,3'-bis-[4-di-4tolylamino)phenyl]-1-phenylpropane. A suitable concentration of the hole-transport material or mixture of materials is in the range of 10–60 wt %, preferably 30–50 wt %, of the dried CTL.

Although any of the binders discussed above in reference to single layer elements are suitable, a preferred polymeric binder for the CTL is bisphenol-A polycarbonate, obtained under the trade name Makrolon TM from Mobay Chemical Corporation. The preferred concentration of the binder ranges from 50–70 wt % of the dried CTL. In addition to the charge-transport materials and polymeric binder, there may be other addenda present in the CTL to enhance performance or physical properties (e.g. leveling aids, adhesion promoters, and the like).

A suitable thickness of the CTL is in the range of 5–30 microns, and a preferred thickness is in the range of 10–20 microns for an inverse composite structure.

The charge generation layer of the present multiactive element can take the form of the photoconductive layer of the single layer element described above (i.e., a near-infrared sensitizer, a near-infrared additive, and, optionally, a binder). Preferably, however, the charge generation layer includes a near-infrared sensitizer and, optionally, a binder, with the near-infrared additive being present in a layer other than the charge generation layer (i.e., the charge transport layer, the subbing, barrier, or overcoat layers, or a separate layer in physical contact with one of the above-mentioned layers).

Although any of the binders thus far discussed are suitable, a preferred binder for use in the charge generation layer of a multiactive electrophotographic element is the copolyester of terephthalic acid, azelaic acid, and 4,4'-(2-norbomylidene)bisphenol, in a molar ratio of about 30/20/50. The binder can be present in the CGL in a concentration in the range from about 1 to 99%, preferably about 65 to 99%, based on the weight of the dried CGL.

As discussed above with reference to single layer elements, other addenda can be present in the CGL of the present invention to enhance performance and/or physical properties of the element, as is known in the art. When present in the preferred inverse composite structure, the CGL of the present element is in the range of about 0.5 to 10 microns, preferably about 4 to 8 microns.

When the near-infrared additive is present in the CTL, the preferred concentration of the near-infrared additive is between about 0.1 and 1.0 weight percent of the dried CTL. In practice, the level of specific additive is adjusted by routine experimentation until the minimum amount necessary to eliminate laser interference is determined.

The present invention also includes an electrophotographic imaging method. The method of the present invention includes the steps of first electrostatically charging the present element. The charged element is exposed image-wise to near-infrared radiation to form an electrostatic latent image which is developed by applying charged toner particles to the element to produce a toned image. The toned image can then be transferred to a suitable receiver (e.g., paper).

The toner particles are in the form of a dust, a powder, a pigment in a resinous carrier, or a liquid developer in which the toner particles are carrier in an electrically insulating liquid carded. Methods of such development are widely known and described as, for example, in U.S. Pat. Nos. 2,296,691, 3,893,935, 4,076,857, and 4,546,060.

The invention is further illustrated by the following examples which include preferred embodiments thereof.

EXAMPLES

Example 1

Two multilayer photoconductive films, Samples A and B, were prepared according to the following procedure. A charge transport layer was prepared by mixing 30 parts by weight tri-4-tolylamine (charge transport material), 67.5 parts by weight bisphenol-A polycarbonate (polymeric binder), and 2.5 parts by weight poly-[ethylene-terephthalate-co-neopentyl-terephthalate-(55/45)](adhesion promoter). This mixture was coated onto a nickellized poly(ethylene terephthalate) support having a thickness of 7 mils and an optical density of 0.4. The dry coverage of the charge transport layer on the element was 13.0 g/m$^2$.

A charge generation layer prepared by mixing 28 parts by weight tri-4-tolylamine (photoconductor), 2 parts by weight diphenylbis-(4-diethylaminophenyl)methane (photoconductor), and 3 parts titanyl tetra-4-fluorophthalocyanine (sensitizer) with 67 parts poly[4,4'-(2-norbomylidene)bisphenol terephthalate-co-azelate-(40/60)](binder) was then coated over the charge transport layer. The dry coverage of the charge generation layer on Sample A was 6.5 g/m$^2$. Sample A did not contain a near-infrared additive and, therefore, served as the control.

Sample B was prepared in the same manner as Sample A, with the exception that 0.30 parts of the binder in the charge transport layer was replaced with near-infrared additive (13) disclosed above. Near-infrared additive (13) was prepared according to procedures described in U.S. Pat. No. 5,028,504.

The relative sensitometric properties of Samples A and B were evaluated by testing the photodecay and dark decay of each. A portion of each film was first corona-charged to about +500 volts (V). The films were then allowed to decay in the dark for 2 seconds (sec), followed by photodecay with an exposure of about 5 erg/cm$^2$-sec at 830 nm. The dark decay is expressed as the rate of charge decay in volts/second (V/sec) over the 2 second period. The amount of exposure required to discharge the film to +100 V is used to compare the photodecays of Samples A and B.

The optical density (O.D.) of each film at 830 nm was determined using a transmission spectrophotometer. Each O.D. as measured was corrected by subtracting 0.40 from each value to compensate for optical density of the nickel conductive layer. The resulting value represents only the optical density due to the CGL and CTL. The results of the sensitometric and optical density evaluations are summarized in Table I below.

TABLE I

| SAMPLE | PHOTODECAY (erg/cm$^2$) | DARK DECAY (V/sec) | O.D. |
|---|---|---|---|
| A (control) | 12 | 2 | 0.59 |
| B | 22 | 3 | 1.10 |

As illustrated by Table I, Sample B exhibits a slightly slower photospeed (higher photodecay value) and a comparable dark decay rate when compared to control Sample A. The slightly lower photosensitivity is not considered to be disadvantageous to performance due to the high power output of the laser intended for imaging these films. It should also be noted that this lower photosensitivity indicates that the near-infrared absorbing additive is not acting as a co-sensitizer in the Sample B. In addition, Table I indicates that the addition of the near-infrared additive to Sample B nearly doubled the optical density of that film as compared to the control.

The samples were also analyzed for regenerational stability. The regeneration tests were conducted by subjecting each sample to 200 cycles of charge, expose, and erase. For each cycle, the samples were: (1) charged to about +500 V with a corona charger, (2) exposed through a step-wedge using a flash exposure (filtered to allow only light with wavelengths greater than about 650 nm to pass through), and (3) erased with a blanket exposure. The voltage just after charging (Vo) and the voltage on a maximally exposed area of the film (Vt) were monitored as a function of cycle number. The resulting data for Samples A and B are set forth in Table II below.

TABLE II

| SAMPLE | Vo CYCLE 1 | Vo CYCLE 200 | Vt CYCLE 1 | Vt CYCLE 200 |
|---|---|---|---|---|
| A (control) | +507 V | +489 V | +61 V | +75 V |
| B | 485 | 471 | 95 | 97 |

As illustrated by Table II, Sample B displays regenerational stability comparable to control Sample A. Ideally, there should be minimal variation in both Vo and Vt upon continuous cycling. Therefore, as shown by Table II, both control Sample A and inventive Sample B exhibit good regenerational stability.

example 2

Four multilayer photoconductive films, designated as Samples C, D, E, and F were prepared as described in Example 1. The charge generation layer of Sample C contained 25 parts by weight 4-dicyanomethylene-2-phenyl-6-(4-tolyl)-4H-thiopyran1,1-dioxide and 5 parts by weight tri-4-tolylamine (photoconductors), 3 parts titanyl tetra-4-fluorophthalocyanine (sensitizer), 67 parts by weight poly[4,4'-(2-norbomylidene)-bisphenol terephthalate-co-azelate-(40/60)](binder). The dry coverage of the CGL was 6.5 g/m$^2$.

The charge transport layer of Sample C contained 19 parts tri-4-tolylamine, 19 parts 1,1-bis-[4-(di-4- tolylamino)phenyl]cyclohexane, and 2 parts diphenylbis-(4-diethylaminophenyl)methane (charge transport materials), 58 parts bisphenol-A polycarbonate (binder) and 2 parts poly[ethylene terephthalate-co-neopentyl-terephthalate-(55/45)](adhesion promoter). The charge transport layer was applied at a dry coverage of 15 g/m$^2$.

Sample D was prepared as described above for Sample C, except that 0.125 parts by weight of the CTL binder was replaced with near-infrared additive (1) disclosed above. Near-infrared additive (1) was prepared by dissolving 7.85 g (0.04 mol) of croconic acid in 200 ml of hot n-butanol. After dissolution of the croconic acid, a solution of 16.4 g (0.08 mol) 2,3,3-tri-methyl-5-nitroindoline in 150 ml toluene was added to the croconic acid solution in one portion. The resulting solution was refluxed for 30 minutes with stirring to crystallize near-infrared additive ( 1 ). This mixture was cooled to room temperature and stirred for two hours. Near-infrared additive (1) was removed by vacuum filtration and washed two times with 50 ml n-butanol and once with 100 ml ether. The molar extinction coefficient of near-infrared additive (1) is $1.5\times10^5$ L-mol$^{-1}$ cm$^{-1}$.

Sample E was prepared as described above for Sample C, except that 0.25 parts by weight of the CTL binder was replaced with near-infrared additive ( 1 ).

Sample F was prepared as described above for Sample C, except that 0.50 parts by weight of the CTL binder was replaced with near-infrared additive ( 1 ).

Samples C, D, E, and F were tested for both photodecay and dark decay. The photodecay was measured with an exposure of about 5 erg/cm$^2$-sec at 830 nm on a sample of film which had been charged to +500 V. The amount of exposure required to discharge the to +100 V is used to compare the photodecays of the different films. The dark decay was measured on film samples which had been equilibrated at 40° C. They were charged to about +600 V, and the amount of charge which is dissipated in the dark for 30 sec was measured. The dark decay is expressed as the rate of charge decay in volts/sec over the 30 sec period. The photodecay and dark decay results, as well as the optical density values, for each film are summarized in Table III below.

TABLE III

| SAMPLE | PHOTODECAY (erg/cm$^2$) | DARK DECAY (V/sec) |
|---|---|---|
| C (control) | 15 | 7.6 |
| D | 19 | 5.1 |
| E | 20 | 6.3 |
| F | 25 | 5.2 |

As illustrated by Table III, Samples D, E, and F exhibit slightly slower photospeeds (higher photodecay values) and advantageously lower dark decay rates than control Sample C. The slightly lower photosensitivities are not deleterious to the performance of the films of the present invention because the slightly decreased sensitivity is easily compensated by the power of the laser used to image the films. The lower dark decay, however, is a significant advantage, especially for electrophotographic processes which operate at low throughputs and/or elevated temperatures.

Samples C, D, E, and F were also evaluated for formation of laser interference patterns. To accomplish this, first the optical density at 830 nm was determined for each of Samples C, D, E, and F using a transmission spectrophotometer. The optical densities as measured were again corrected by subtracting 0.40 to compensate for the nickel conductive layer. The resulting optical density, therefore, is attributable to only the charge generation and charge transport layers of the elements.

Each sample was evaluated for laser interference patterns in the following manner. The samples were charged to about +500 V with a corona charger, and were then imaged with an 830 nm laser such that a 100 mm×160 mm area of the film received a constant exposure. The exposure was chosen to yield a toned image which upon transfer to a white paper receiver displays a reflection density of about 1.0. For films which display the laser interference pattern, a pattern similar to the appearance of "wood grain" can be seen in the toned image, either before or after transfer. Films which do not display the laser interference patterns yield very uniform images of constant density. The results of these tests are set forth in Table IV below.

TABLE IV

| SAMPLE | O.D. at 830 nm | INTERFERENCE PATTERNS |
|---|---|---|
| C (control) | 0.34 | Yes |
| D | 0.60 | Yes |
| E | 0.81 | No |
| F | 1.40 | No |

As illustrated by Table IV, a minimum optical density between about 0.6 and 0.8 is required to effectively eliminate the laser interference patterns.

Full-process regeneration tests were performed on Films C, D, E, and F as follows. First the film was subjected to 200 cycles of full-process imaging on a breadboard, each cycle comprising the steps of: (1) charging to about +600 V with a corona charger, (2) exposing optically through a transparent original using a flash exposure which had been filtered to allow only light with wavelengths greater than about 650 nm to pass through, (3) developing with a two component positive charging developer, (4) transferring to a receiver, (5) cleaning with a fur brush cleaner, and (6) erasing with a blanket exposure. The voltages on the maximally exposed (Vt) and minimally exposed (Vs) areas of the film, as determined by an electrometer placed immediately before the development station, were monitored as a function of cycle number. Ideally, there should be minimal variation in both Vt and Vs upon continuous cycling.

The resulting data for Samples C, D, E, and F are summarized in Table V below.

TABLE V

| | Vs CYCLE | | Vt CYCLE | |
|---|---|---|---|---|
| SAMPLE | 1 | 200 | 1 | 200 |
| C (control) | +565 V | +548 V | +121 V | +108 V |
| D | +602 | +586 | +102 | +121 |
| E | +607 | +576 | +116 | +116 |
| F | +599 | +572 | +154 | +131 |

As shown by Table VI Samples C, D, E, and F all display good regenerational stability.

Example 3

Two multilayer photoconductive films, Sample G and H, were prepared as described above in Example 2. The charge generation layer of Sample G (control) contained 25 parts by weight 4-dicyanomethylene-2-phenyl-6-(4-tolyl)-4H-thiopyran1,1-dioxide and 5 parts by weight tri-4-tolylamine (photoconductors), 3 parts titanyl tetra-4-fluorophthalocyanine (sensitizer), and 67 parts by weight poly[4,4'-(2-norbornylidene)-bisphenol terephthalate-co-azelate-(40/60)](binder). The dry coverage of the charge generation layer was 6.5 g/m$^2$.

The charge transport layer of Sample G contained 19 parts tri-4-tolylamine, 19 parts 1,1-bis-[4-(di-4- tolylamino)phenyl]cyclohexane, and 2 parts diphenylbis(4-diethylaminophenyl)methane (charge transport materials), 58 parts bisphenol-A polycarbonate (binder) and 2 parts poly[ethylene terephthalate-co-neopentyl-terephthalate-(55/45)](adhesion promoter). The charge transport layer was applied at a dry coverage of 15 g/m$^2$.

Sample H had the same composition as Sample G above with the exception that 0.25 parts of the binder of the charge transport layer was replaced with near-infrared additive (29) disclosed above. Near-infrared additive (29) was prepared according to procedures described in U.S. Pat. Nos. 4,365,017, 4,916, 127, and 4,963,669.

Samples G and H were tested for both photodecay and dark decay in accordance with the procedures described above in Example 2. The photodecay and dark decay results are summarized below in Table VI.

TABLE VI

| SAMPLE | PHOTODECAY (erg/cm$^2$) | DARK DECAY (V/sec) |
|---|---|---|
| G (control) | 23 | 8.4 |
| H | 36 | 7.0 |

As shown by Table VI, Sample H exhibits a slightly slower photospeed (higher photodecay value) and a lower dark decay rate than control Sample G. Again, as noted above, the lower photosensitivity is not considered deleterious to performance because the lasers commonly used for imaging rims like those described in accordance with the present invention have a sufficient power output to make up for the slight differences in speed. The lower dark decay, however, is a significant advantage, especially for electrophotographic processes which operate at low throughputs and/or elevated temperatures.

Samples G and H were also evaluated for laser interference patterns in the same manner as described in Example 2. The results of these tests are summarized in Table VII below.

TABLE VII

| SAMPLE | O.D. at 830 nm | INTERFERENCE PATTERNS |
|---|---|---|
| G (control) | 0.40 | Yes |
| H | 1.11 | No |

As shown by Table VII, Sample G, which contains near-IR additive (29), surpasses the minimum optical density requirement established in Example 2, and, in addition, does not result in laser interference patterns.

Although the invention has been described in detail for the purpose of illustration, it is understood that such detail is solely for that purpose, and variations can be made therein by those skilled in the an without departing from the spirit and scope of the invention which is defined by the following claims.

What is claimed is:

1. An electrophotographic element for electrostatic imaging exhibiting a reduced tendency toward the development of laser interference patterns, comprising:

a conductive substrate and a photoconductive layer including a near-infrared radiation absorbing sensitizer and a near-infrared radiation absorbing additive.

2. An electrophotographic element according to claim 1, wherein said near-infrared absorbing additive has a molar extinction coefficient greater than about $1\times10^5$ L-mol$^{-1}$-cm$^{-1}$.

3. An electrophotographic element according to claim 1, wherein said near-infrared radiation absorbing additive is selected from the group consisting of compounds having the formula:

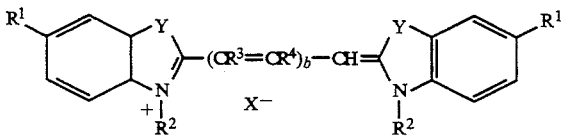

wherein:

$R^1$ is —H, —$NO_2$, alkyl, aryl, —$SO_2R^5$, halo, —$OR^5$, $$-\overset{O}{\overset{\|}{C}}R^5,\quad -O\overset{O}{\overset{\|}{C}}R^5,\quad -\overset{O}{\overset{\|}{C}}OR^5,$$

where $R^5$ is alkyl, aryl, or substituted alkyl or aryl;

$R^2$ is —H or an alkyl from 1–12 carbons;

$R^3$ and $R^4$ can be the same or different and are $$-\overset{O}{\overset{\|}{C}}-R^6,$$

halo, alkyl, or aryl; where $R^6$ is alkyl, aryl or substituted alkyl or aryl, or may be a link of 0–3 carbons to form a ring;

Y is —S—, —O—, or —$C(R^7)_2$— where $R^7$ is H or an alkyl group of 1–3 carbons;

X—is an anion; and b is an integer from 1–3; and compounds having the formula:

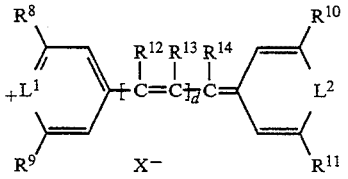

wherein:

$L^1$ and $L^2$ can be the same or different and are Te, Se, S, or O;

$R^8$, $R^9$, $R^{10}$, and $R^{11}$ can be the same or different and are H or an alkyl group having from 1–5 carbons;

$R^{12}$, $R^{13}$, and $R^{14}$ can be the same or different and are —H or —$CH_3$;

—X is an anion; and d is 1 or 2.

4. An electrophotographic element according to claim 3, wherein said near-infrared radiation absorbing additive is selected from the group consisting of compounds having the formula:

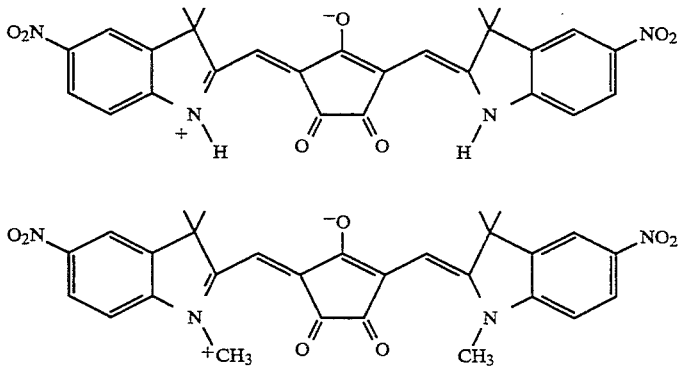

-continued

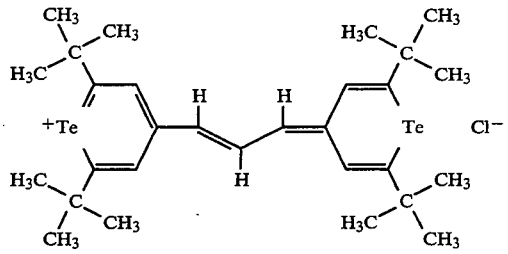

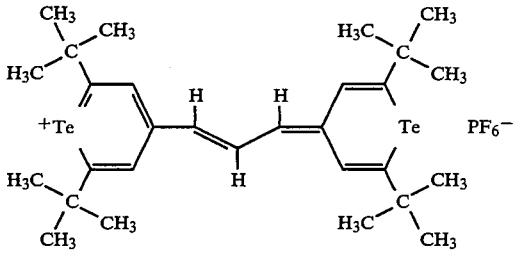

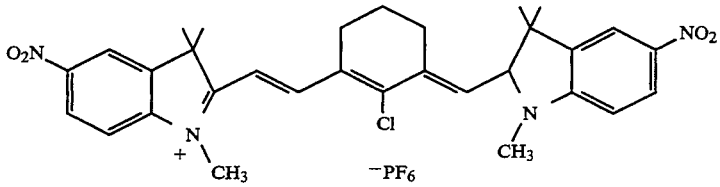

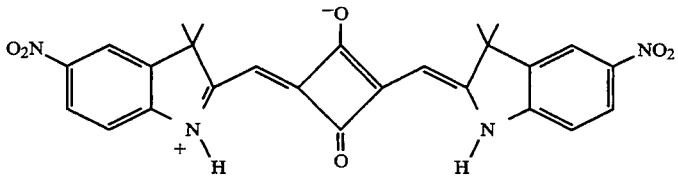

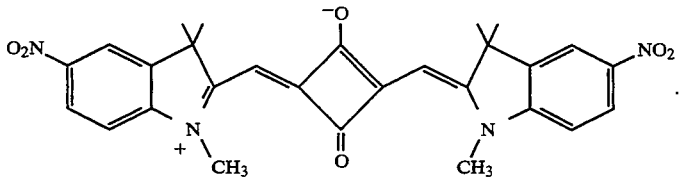

5. An electrophotographic element according to claim 1, wherein said element is multiactive and said photoconductive layer is a charge generation layer, said element further comprising a charge transport layer.

6. An electrophotographic element according to claim 5, wherein said near-infrared radiation absorbing additive is selected from the group consisting of compounds having the formula:

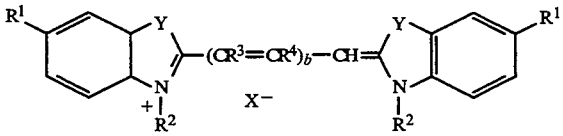

wherein:

$R^1$ is —H, —$NO_2$, alkyl, aryl, —$SO_2R^5$, halo, —$OR^5$,

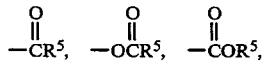

where $R^5$ is alkyl, aryl, or substituted alkyl or aryl;

$R^2$ is —H or an alkyl from 1-12 carbons;

$R^3$ and $R^4$ can be the same or different and are

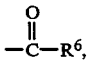

halo, alkyl, or aryl; where $R^6$ is alkyl, aryl or substituted alkyl or aryl, or may be a link of 0-3 carbons to form a ring;

Y is —S—, —O—, or —$C(R^7)_2$— where $R^7$ is H or an alkyl group of 1-3 carbons;

X—is an anion; and b is an integer from 1-3; and compounds having the formula:

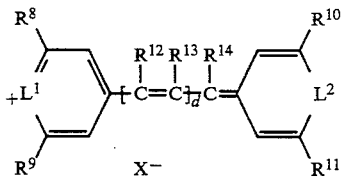

wherein:

$L^1$ and $L^2$ can be the same or different and are Te, Se, S, or O;

$R^8$, $R^9$, $R^{10}$, and $R^{11}$ can be the same or different and are —H or an alkyl group having from 1–5 carbons;

$R^{12}$, $R^{13}$, and $R^{14}$ can be the same or different and are —H or —$CH_3$;

—X is an anion; and d is 1 or 2.

7. An electrophotographic element according to claim 5, wherein said near-infrared radiation absorbing additive is selected from the group consisting of compounds having the formula:

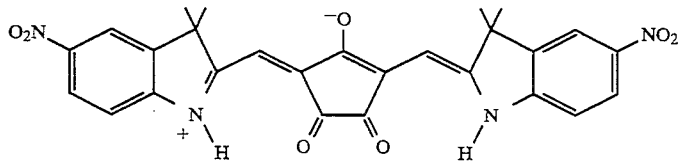

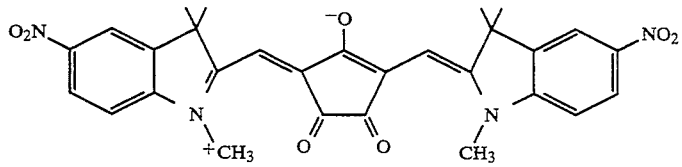

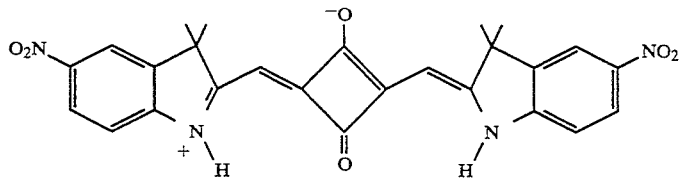

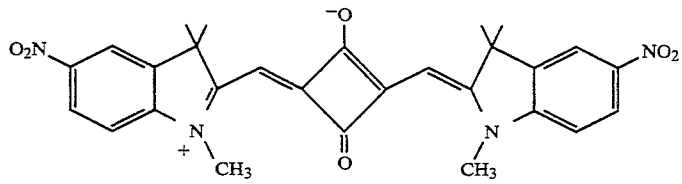

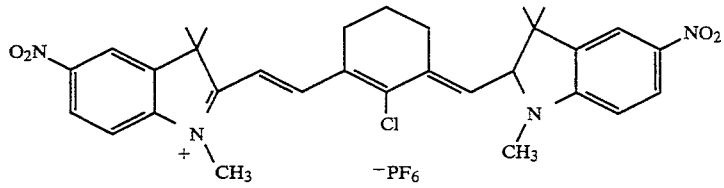

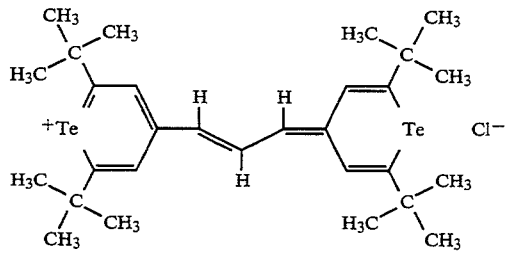

-continued

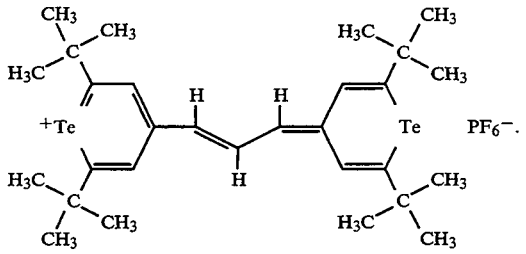

8. A multiactive electrophotographic element for electrostatic imaging exhibiting a reduced tendency toward development of laser interference patterns, comprising:

a conductive substrate;

a charge generation layer including a near-infrared radiation absorbing sensitizer;

a charge transport layer; and a near-infrared radiation absorbing additive present in said electrophotographic element between said conductive substrate and said charge generation layer.

9. An electrophotographic element according to claim 8, wherein said near-infrared absorbing additive has a molar extinction coefficient greater than about $1\times10^5$ L-mol$^{-1}$-cm$^{-1}$.

10. An electrophotographic element according to claim 8, wherein said near-infrared radiation absorbing additive is selected from the group consisting of compounds having the formula:

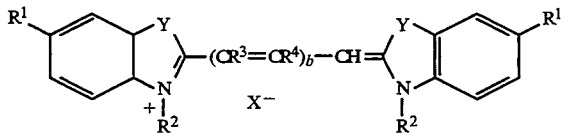

wherein:

$R^1$ is —H, —$NO_2$, alkyl, aryl, —$SO_2R^5$, halo, —$OR^5$,

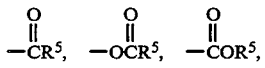

where $R^5$ is alkyl, aryl, or substituted alkyl or aryl;

$R^2$ is —H or an alkyl from 1–12 carbons;

$R^3$ and $R^4$ can be the same or different and are

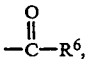

halo, alkyl, or aryl; where $R^6$ is alkyl, aryl or substituted alkyl or aryl, or may be a link of 0–3 carbons to form a ring;

Y is —S—,—O—, or —$C(R^7)_2$— where $R^7$ is H or an alkyl group of 1–3 carbons;

X—is an anion; and b is an integer from 1–3; and compounds having the formula:

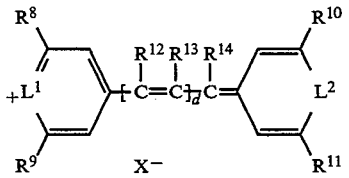

wherein:

$L^1$ and $L^2$ can be the same or different and are Te, Se, S, or O;

$R^8$, $R^9$, $R^{10}$, and $R^{11}$ can be the same or different and are —H or an alkyl group having from 1–5 carbons;

$R^{12}$, $R^{13}$, and $R^{14}$ can be the same or different and are —H or —$CH_3$;

—X is an anion; and d is 1 or 2.

11. An electrophotographic element according to claim 10, wherein said near-infrared radiation absorbing additive is selected from the group consisting of compounds having the formula:

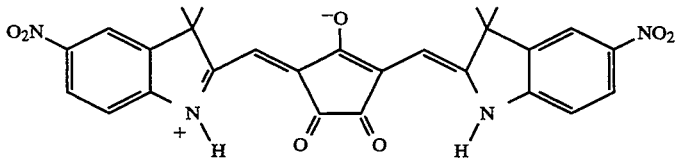

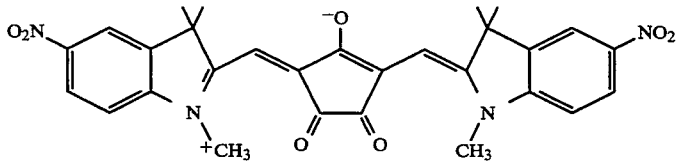

-continued

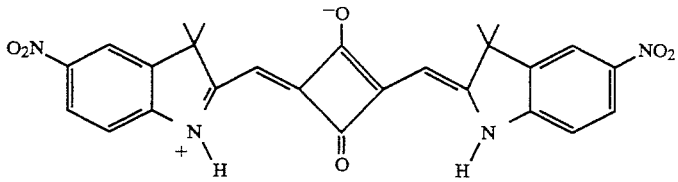

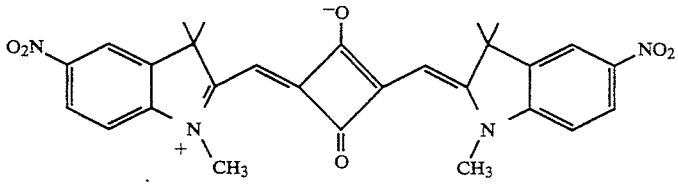

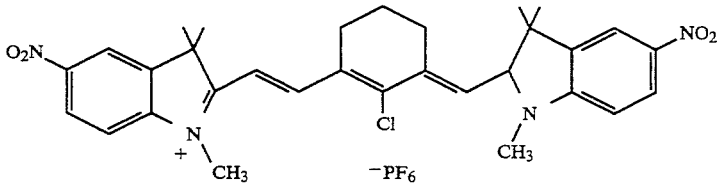

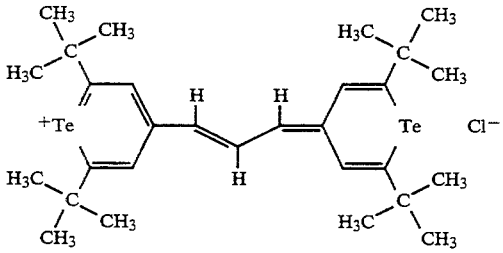

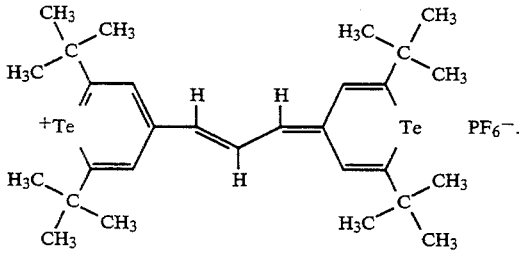

12. An electrophotographic element according to claim 8, wherein said near-infrared absorbing additive is contained in said charge transport layer.

13. An electrophotographic element according to claim 8, further comprising a subbing or barrier layer and wherein said near-infrared absorbing additive is contained in said subbing or barrier layer.

14. An electrophotographic element according to claim 8, wherein said near-infrared absorbing additive is contained in a separate layer.

15. An electrophotographic method comprising the steps of electrostatically charging an element comprising:

a conductive substrate and a photoconductive layer including a near-infrared radiation absorbing sensitizer and a near-infrared radiation absorbing additive;

exposing said element imagewise to near-infrared radiation to form an electrostatic latent image;

developing said electrostatic latent image by applying charged toner particles to said element to produce a toned image; and transferring the toned image to a suitable receiver.

16. An electrophotographic method according to claim 15, wherein said near-infrared absorbing additive has a molar extinction coefficient greater than about $1\times10^5$L-mol$^{-1}$-cm$^{-1}$.

17. An electrophotographic method according to claim 16, wherein said near-infrared radiation absorbing additive is selected from the group consisting of compounds having the formula:

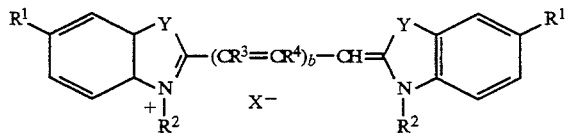

wherein:

$R^1$ is —H, —$NO_2$, alkyl, aryl, —$SO_2R^5$, halo, —$OR^5$, $$-\overset{O}{\overset{\|}{C}}R^5,\quad -O\overset{O}{\overset{\|}{C}}R^5,\quad -\overset{O}{\overset{\|}{C}}OR^5,$$

where $R^5$ is alkyl, aryl, or substituted alkyl or aryl;

$R^2$ is —H or an alkyl from 1–12 carbons;

$R^3$ and $R^4$ can be the same or different and are $$-\overset{O}{\overset{\|}{C}}-R^6,$$

halo alkyl or aryl; where $R^6$ is alkyl, aryl or substituted alkyl or aryl, or may be a link of 0–3 carbons to form a ring;

Y is —S—,—O—, or—$C(R^7)_2$— where $R^7$ is H or an alkyl group of 1–3 carbons;

X—is an anion; and b is an integer from 1–3; and compounds having the formula:

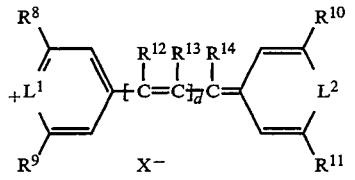

wherein:

$L^1$ and $L^2$ can be the same or different and are Te, Se, S, or O;

$R^8$, $R^9$, $R^{10}$, and $R^{11}$ can be the same or different and are —H or an alkyl group having from 1–5 carbons;

$R^{12}$, $R^{13}$, and $R^{14}$ can be the same or different and are —H or —$CH_3$;

—X is an anion; and d is 1 or 2.

18. An electrophotographic method comprising the steps of: electrostatically charging an element comprising:

a conductive substrate;

a charge generation layer including a near-infrared radiation absorbing sensitizer;

a charge transport layer; and a near-infrared radiation absorbing additive present in said electrophotographic element between said conductive substrate and said charge generation layer;

exposing said element imagewise to near-infrared radiation to form an electrostatic latent image;

developing said electrostatic latent image by applying charged toner particles to said element to produce a toned image; and transferring the toned image to a suitable receiver.

19. An electrophotographic method according to claim 18, wherein said near-infrared radiation absorbing additive is selected from the group consisting of compounds having the formula:

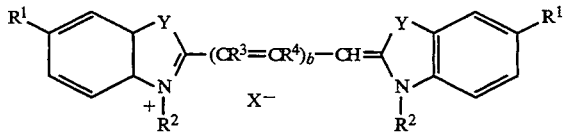

wherein:

$R^1$ is —H, —$NO_2$, alkyl, aryl, —$SO_2R5$, halo, —$OR^5$, $$-\overset{O}{\overset{\|}{C}}R^5,\quad -O\overset{O}{\overset{\|}{C}}R^5,\quad -\overset{O}{\overset{\|}{C}}OR^5,$$

where $R^5$ is alkyl, aryl, or substituted alkyl or aryl;

$R^2$ is —H or an alkyl from 1–12 carbons;

$R^3$ and $R^4$ can be the same or different and are $$-\overset{O}{\overset{\|}{C}}-R^6,$$

halo, alkyl, or aryl; where $R^6$ is alkyl, aryl or substituted alkyl or aryl, or may be a link of 0–3 carbons to form a ring;

Y is—S—,—O—, or—CCR 7)$_2$— where $R^7$ is H or an alkyl group of 1–3 carbons;

X—is an anion; and b is an integer from 1–3; and compounds having the formula:

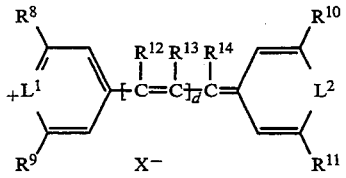

wherein $L^1$ and $L^2$ can be the same or different and are Te, Se, S, or O;

$R^8$, $R^9$, $R^{10}$, and $R^{11}$ can be the same or different and are —H or an alkyl group having from 1–5 carbons; $R^{12}$, $R^{13}$, and $R^{14}$ can be the same or different and are —H or —$CH_3$;

—X is an anion; and d is 1 or 2.

20. An electrophotographic method according to claim 18, wherein said near-infrared radiation absorbing additive is selected from the group consisting of compounds having the formula:

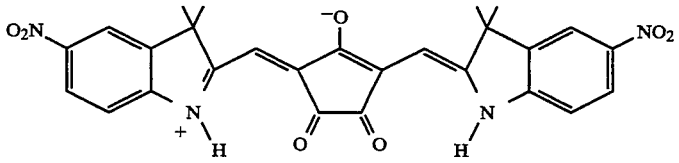

-continued
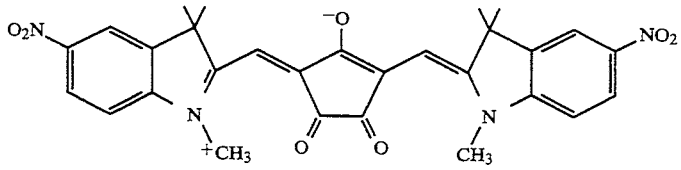
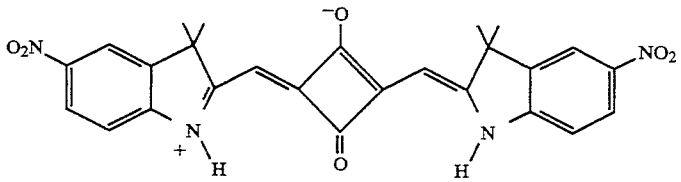
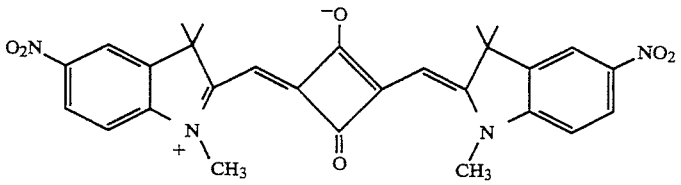
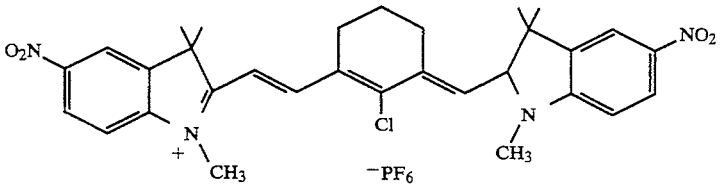
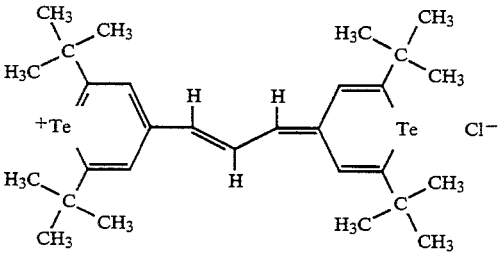
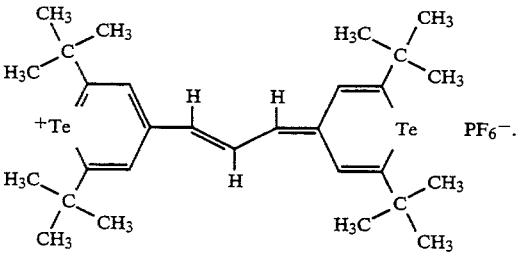
* * * * *